United States Patent [19]

Boyer

[11] Patent Number: 4,964,634

[45] Date of Patent: Oct. 23, 1990

[54] TETHERED BALL BATTING PRACTICE DEVICE

[75] Inventor: Ralph Boyer, Crystal City, Mo.

[73] Assignee: Incrediball, Inc., Concord, Calif.

[21] Appl. No.: 339,383

[22] Filed: Apr. 17, 1989

[51] Int. Cl.[5] ..... A63B 69/00

[52] U.S. Cl. ..... 273/26 E

[58] Field of Search ..... 273/26 E, 29 A, 184 B, 273/185 C, 200 R, 208, 58 C, 413, 26, 29, 184, 185, 200, 58

[56] References Cited

U.S. PATENT DOCUMENTS

| | | | |
|---|---|---|---|
| 1,326,976 | 1/1920 | Schnurr | 273/200 R |
| 1,579,294 | 4/1926 | Fisk | 273/200 R |
| 3,122,369 | 2/1964 | Windall | 273/185 C |
| 3,297,321 | 1/1967 | Kuhnes et al. | 273/26 R |
| 3,425,700 | 2/1969 | Edwards | 273/185 C |
| 3,494,621 | 2/1970 | Windall | 273/200 R |
| 3,498,613 | 3/1970 | Dreyer | 273/319 |
| 3,521,887 | 7/1970 | Butkus | 273/200 R |
| 3,531,115 | 9/1977 | Alexander | 273/58 C |
| 3,767,198 | 10/1973 | Boyer | 273/26 E |
| 3,802,409 | 4/1974 | Mike et al. | 273/200 R |
| 3,874,662 | 4/1975 | Harrington | 273/26 E |
| 4,095,787 | 6/1978 | Saferstein | 273/413 |
| 4,462,589 | 7/1984 | Morgan | 273/60 R |
| 4,660,835 | 4/1987 | Locurto | 273/200 R |
| 4,772,019 | 9/1988 | Morgan | 273/60 B |

FOREIGN PATENT DOCUMENTS

| | | | |
|---|---|---|---|
| 1039879 | 5/1953 | France | 273/413 |

*Primary Examiner*—Theatrice Brown

*Attorney, Agent, or Firm*—Flehr, Hohbach, Test, Albritton & Herbert

[57] ABSTRACT

A batting practice or baseball pitching device having a bat tethered by cord with an elastic section. The cord is anchored by a primary anchor midway between the pitcher and the batter. An auxiliary anchor is coupled proximate the primary anchor to prevent the primary anchor from being propelled toward the pitcher. The ball is lighter in weight, and preferably softer, than a regulation baseball, and the elastic section of the cord is sufficiently short to permit pitching or propelling the ball by using a lean forward, lean backward pitching technique.

8 Claims, 1 Drawing Sheet

TETHERED BALL BATTING PRACTICE DEVICE

TECHNICAL FIELD

The present invention relates, in general, to baseball batting practice devices, and more particularly, to an apparatus which has an anchored, tethered ball which can be resiliently propelled or pitched to a batter for baseball batting practice.

BACKGROUND ART

Various powered pitching machines are known which are used for baseball batting practice and are intended primarily for use by professional or well financed college baseball teams. Such devices are typically relatively complex in construction, require an electrical or other power source, are quite costly and seldom available for use by amateurs or casual players.

The other end of the pitching machine spectrum is the batting tee. Baseball batting tees are widely used by professionals and amateurs alike, and they can be quite useful in various types of batting drills. Such batting tees, however, lack the eye-hand coordination or training which results from trying to hit a moving baseball.

An intermediate form of batting practice or pitching machine device is shown in my U.S. Patent No. 3,767,198. This patent discloses the use of a baseball which is mounted to a long tether that: includes an elastic link or length of cord which can be used to propel or "pitch" the baseball across the plate to a batter. The tether also absorbs energy and limits the flight of the ball when it is hit.

The form of batting practice device or pitching assembly shown in my U.S. Patent No. 3,767,198 is particularly well suited for use by amateur players in that it is relatively inexpensive, it is easy to set up, and amateur players can develop considerable batting skills using the device. Such batting practice devices, however, do have certain disadvantages. First, there are potential safety hazards, particularly when the ball is being pitched. The tether is anchored, usually by a ground stake, which can become dislodged or loosened as the elastic section of the tether is being stretched to generate the ball propelling force. This stretching action is a relatively slow elongation of the elastic cord, but if the ground stake should pull out of the ground while the pitcher is stretching the elastic cord, the ground stake becomes a dangerous projectile which will be propelled toward the pitcher. Since anchor or ground stakes usually are metallic and have a pointed end, the stake can become a formidable missile and substantial safety hazard.

The possibility of dislodging the ground stake upon batting of the baseball is less, and the danger to the pitcher is also much less. Nevertheless, there is always the prospect that the batted ball will also pull the anchor stake out of the ground, with the result that the pitcher can be hit by a highspeed, hard baseball and/or stake.

Another disadvantage of the tether pitching assembly of my U.S. Patent No. 3,767,198 is that amateur players have some difficulty in reproducibly projecting or propelling the ball over the plate in or about the strike zone of the batter. While the general technique of propelling or pitching the baseball using the tethered ball apparatus of U.S. Patent No. 3,767, 198 is easily learned, it is somewhat more difficult to reproducibly pitch the ball in the strike zone using the apparatus. If the ball is repeatedly propelled by the apparatus outside the strike zone, the batter may develop bad batting habits and may swing at too many pitches that are outside the strike zone just to try to practice making contact with the moving ball.

One of the reasons that it is somewhat difficult to reproducibly propel the ball over the plate in the strike zone using my prior tethered baseball apparatus is that the elastic section was sufficiently long that the pitcher must step away from the batter during tensioning. Thus a step away from the batter was normally required in order to stretch the elastic section sufficiently to propel the baseball across the plate at about a normal pitching speed. Such stepping by the pitcher during the tensioning of the tether seldom is uniform, and tends to combine with other non-uniform arm and torso motions to induce variation into propulsion of the ball. The result is that some of the pitches are over the plate in the strike zone, but many are not.

An additional safety hazard which is present in the tethered ball pitching apparatus of my U.S. Pat. No. 3,767,198 is that a hard, regulation baseball has been used which is pitched by the device at speeds over 80 miles per hour. If the ball hits the batter, therefore, it can cause substantial injuries.

U.S. Pat. No. 3,802,409 discloses another type of baseball pitching or throwing device. The device incorporates the principle of slingshot projection, and it contains a frame member to which an elastic strap is connected. The baseball is positioned at the center of the strap, which is pulled and then released to project the ball. The ball is connected at one end to a cord secured to the frame of the slingshot assembly. This approach, however, requires a relatively bulky frame, which increases the cost and reduces the portability of the apparatus as compared, for example, to the pitching apparatus of my U.S. Pat. No. 3,767,198.

The tethering of balls also broadly is known in connection with both baseball and golf practice devices. Usually these balls are mounted to a tether which is designed to absorb energy imparted to the ball when the ball is hit by a baseball bat or a golf club. The tether is not used to propel or pitch the ball. Examples of such devices are disclosed in U.S. Pat. Nos. 1,326,976, 3,425,700 and 3,874,662. Similarly, U.S. Pat. Nos. 1,326,976, 3,297,321 and 4,660,835 disclose the use of balls which are tethered and anchored by ground assemblies which are designed to absorb energy once the ball is hit. Other examples of energy absorbing ground stakes are shown in U.S. Pat. Nos. 3,122,369, 3,494,621 and 3,521,887. In all of these devices, however, the ball is always moving away from the baseball player or golfer when the ground stake assembly is stressed or begins to absorb energy from the moving ball. Since the ball is moving away from the player, there is not a significant safety hazard if one or more of the stakes should pull from the ground and be propelled in the direction of the ball. Thus, these anchor assemblies are not designed for, nor do they function as, safety devices, but instead are merely energy absorbing systems to limit the flight of the ball away from the player who imparts motion to the ball.

Accordingly, it is an object of the present invention to provide a baseball batting practice device of the type including an anchored, tethered ball which may be used to simulate pitching and has substantially improved safety.

It is a further object of the present invention to provide a baseball batting practice device which is inexpensive, and which can be used by amateur players, as well as professional players.

Another object of the present invention is to provide a baseball pitching device which is constructed so that it is easier to reproducibly pitch the ball across the plate in the strike zone.

It is still another object of the present invention to provide a baseball pitching assembly of the type that applies a force to a primary anchor stake in a direction toward the user and which has an auxiliary anchor that decelerates the primary anchor in the event that the primary anchor is dislodged from its anchoring position.

It is a further object of the present invention to provide a batting practice device which enables the pitcher to pitch a safety baseball toward a batter at high speed without stepping away from the batter, thereby producing a more accurate, reproducible and safe pitch.

It is still another object of the present invention to provide a batting practice device which utilizes a ball that is constructed so as to substantially reduce the risk of injury to players and physical damage to property, has performance characteristics closely simulating those of a baseball or softball, and is very durable.

The batting practice device of the present invention has other features and objects of advantage which will become apparent from and are set forth in more detail in the accompanying drawings and following description of the Best Mode of Carrying Out The Invention

DISCLOSURE OF INVENTION

The batting practice device of the present invention comprises, briefly, a ball, a cord having a first end attached to the ball, and primary anchor secured to a second end of the cord for anchoring the tethered ball at an anchoring position between the pitcher and batter. The cord of the device of the present invention includes an elastic portion for propelling the ball. The improvement in the batting practice device of the present invention is comprised, briefly, of an auxiliary anchor which is coupled to either the primary anchor or the second end of the cord for stress loading of the auxiliary anchor when the primary anchor is moved from the anchoring position. The auxiliary anchor is coupled to the primary anchor or cord in a manner which does not interfere with stretching of the elastic portion of the cord means to propel the ball.

In another aspect of the present invention a lightweight safety baseball is secured to the cord and the cord has an elastic portion which is of sufficient elasticity and length to permit the pitcher to propel the safety baseball in a simulated pitch by: (i) standing at the mound with a front foot on the mound and a rear foot a half or full step back, (ii) holding the ball with the arms reaching toward the plate, the elbows straight and the cord taught, (iii) leaning away from the batter without stepping by bending at the waist and slightly bending the knees while keeping the elbows straight to fully extend the elastic portion of the cord, and (iv) then releasing the ball by a slight upward toss to produce the proper trajectory.

BEST MODE OF CARRYING OUT THE INVENTION

Figures 1, 2, 3, 4:
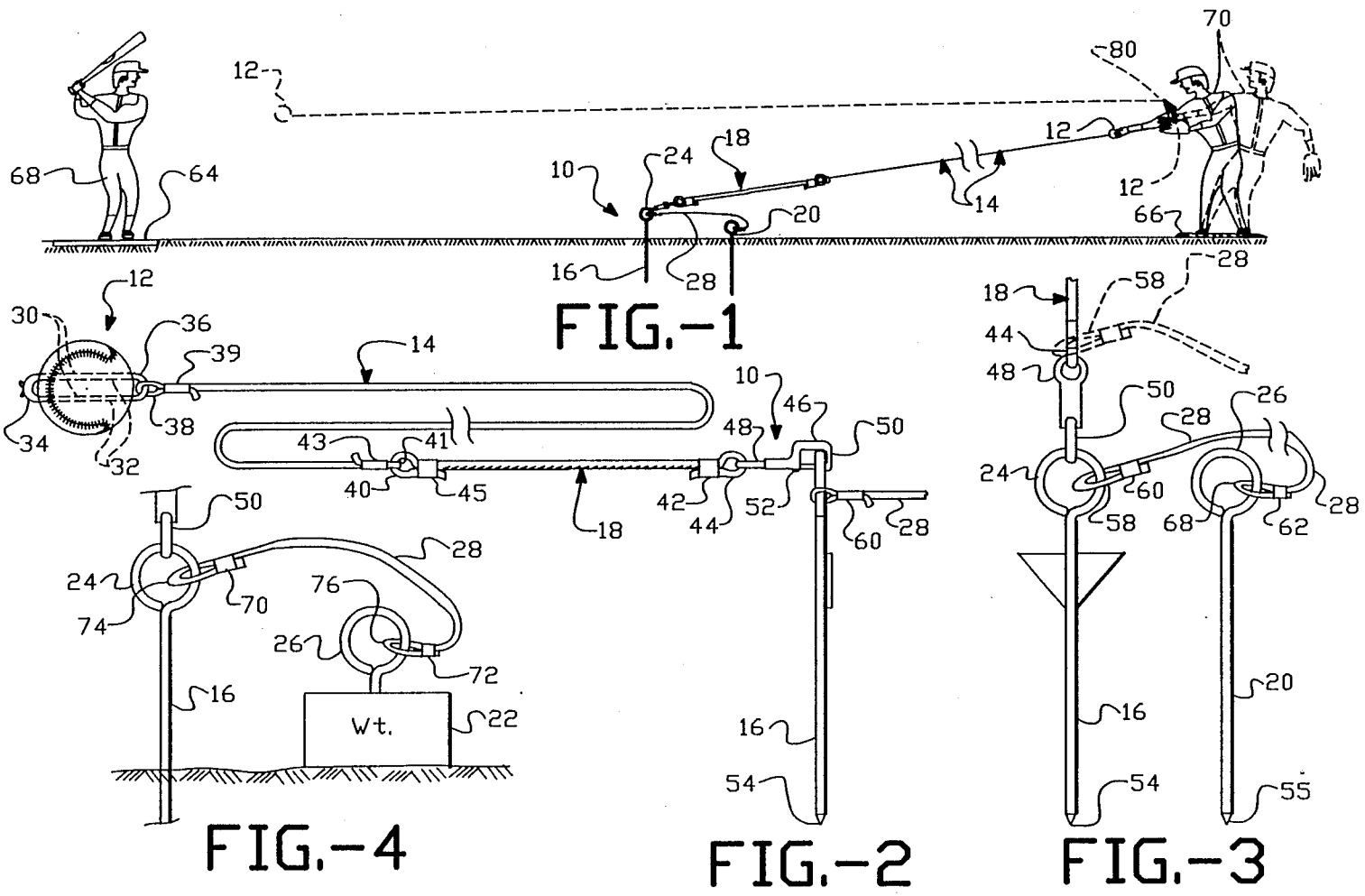
FIG. 1 is a diagrammatic side elevation view of the batting practice device of the present invention and the manner of its use.
FIG. 2 is an enlarged side elevation view of the batting practice device of the present invention.
FIG. 3 is a fragmentary, end elevation view of one embodiment of the primary and auxiliary anchors of the batting practice device of the present invention.
FIG. 4 is a fragmentary side elevation view of an alternative embodiment of the primary and auxiliary anchors of the batting practice device of the present invention.

Referring to the drawings more particularly by reference numerals, FIGS. 1 and 2 show the baseball batting practice device and a diagrammatic illustration of use of the present device. The batting practice device of the present invention, generally designated 10, includes a ball 12, cord means 14 having a first end 38 attached to ball 12, and primary anchor means 16 secured to a second end 44 of cord means 14. Anchor 16 anchors ball 12 at an anchoring position approximately midway between a pitcher 70 and a batter 68. Cord means 14 further includes elastic portion 18, adjacent and preferably attached to anchor 16, for propelling ball 12 toward batter 68.

As thus far described, batting practice device 10 of the present invention has elements which are set forth in the batting practice device of my U.S. Pat. No. 3,767,198.

The present invention, however, is further constructed to include an auxiliary anchor means 20 coupled to either primary anchor means 16 or second end 44 of cord means 14. Stress loading of auxiliary anchor means 20 preferably only occurs when anchor 16 is moved (pulled out of the ground), and auxiliary anchor 20 is coupled to the primary anchor or cord end 44 so as not to interfere with stretching of elastic portion 18 of cord means 14 during propulsion of ball 12.

The device of the present invention is used by pitcher 70 by pulling back on ball 12 and elastic portion 18 of cord means 14 slowly to generate the ball propelling force. When the pitcher releases ball 12, it is propelled to home plate 64 to batter 68 for hitting. The ball does not need to traVel beyond plate 64 since, if properly hit, the batter will hit the ball in front of plate 64. In the preferred positioning of the anchor relative to plate the ball is propelled to about the rear edge of the plate.

One of the advantages of the pitching assembly of the present invention is that the ball does not go beyond the plate and therefore cannot become wrapped around the batter or bat. Moreover, the short elastic section of the apparatus produces rapid acceleration at the pitching mound and rapid and controlled deceleration at the plate. A tether that was all elastic cord, for example, would slowly accelerate and slingshot past the batter in an uncontrolled fashion having the potential for dangerous backlash.

The slow elongation of elastic portion 18, as compared to the elongation that occurs when ball 12 is struck, places the pitcher at some risk of pulling primary anchor stake 16 out of the ground and propelling it toward the pitcher as he holds ball 12. The high speed movement of stake 16, with its pointed end 54, can pose a formidable safety hazard.

Thus, in the improved batting practice device of the present invention auxiliary anchor means 20 prevents propulsion of anchor stake 16 toward pitcher 70.

Auxiliary anchor 20 can take any form which is suitable for dissipating the energy stored in elastic portion 18 of cord means 14 and which is imparted to primary anchor means 16, either during the pitching process or when the ball is hit.

A preferred embodiment of auxiliary anchor means 20 is shown in FIGS. 1, 2 and 3. Auxiliary anchor means 20 is formed as an anchor stake which is driven into the ground. Anchor stake 20 can be made of metal, plastic or any material sufficiently rigid to be driven into the ground. Preferably, anchor stake 20 should have a pointed end 55 to facilitate its piercing the ground surface and to enable it to be driven deeply enough into the ground for secure anchoring.

In an alternative embodiment, auxiliary anchor means 20 can be formed as a weight or mass 22, as shown in FIG. 4. Mass 22 need not be positively anchored to the ground. However, it should have sufficient inertia so that the relatively low mass of cord means 14 and primary anchor stake 16 can be dissipated when energy is imparted to the primary stake.

Auxiliary anchor 20 can be coupled to either primary anchor 16 or the second end 44 of cord 14. In one embodiment, primary anchor 16 includes eyelet 24 at its upper end and auxiliary anchor 20 also includes eyelet 26 at its upper end. Flexible cord means 28 is fastened between eyelets 24 and 26 to connect primary and auxiliary anchor means 16 and 20, respectively. Stretching of elastic length 18, therefore, is not affected by the auxiliary anchor, and auxiliary anchor 18 does not act to retard the flight of ball 12 toward batter 68 or away from the batter when hit. The auxiliary anchor only functions in the event that primary anchor 16 is pulled from the ground.

Similarly, if cord 28 is connected to second end 44 of propulsion cord 14 shown in broken lines in FIG. 3, there should be sufficient slack such that the auxiliary anchor will not retard the flight of the ball during pitching or batting. Since second end 44 is merely a loop located substantially at anchor stake 16, its motion is very limited and easily accommodated by a small amount of slack in cord 28.

A variety of attaching assemblies can be employed to attach cord 14 to ball 12 and to primary anchor 16. One type of attaching assembly is shown in FIG. 2. Two passageways or channels 30 can be formed through ball 12, which are parallel to the diameter of ball 12. A length of cord material 32 can be fed through one channel 30, returned through the other channel, and secured at 34, for example, by a clip 39 or knotting or heat sealing. A loop 36 in cord 30 can then be used to secure first end 38 of cord 14, for example, by knotting or heat sealing. The opposite end 41 of the relatively inelastic section of cord means 14 can be looped through looped end 40 of elastic portion 18 and secured by a clip 43. Looped end 40 of elastic section 18 also can be fastened by metal or nylon clip 45. Looped or second end 44 of cord assembly 14 can be secured at the other end of elastic portion 18 by metal clip 42. Detachable clasp 46 includes loop portion 48 inserted in looped end 44 and hook end 50 closed by movable slide gate 52. Anchor stake 16 has an eyelet 24 which is engaged by hook 50.

FIG. 3 shows auxiliary anchor stake 20 coupled to primary anchor stake 16. One end 58 of flexible cord 28 is fed through eyelet 24 folded back and secured by clip 60. At it other end, flexible cord 28 is looped through eyelet 26 folded back and secured by another clip 62.

In FIG. 4 the auxiliary anchor means is in the form of mass 22 coupled to primary anchor means 16 in a manner which is identical to that shown in FIG. 3. One end of flexible cord means 28 can be looped at 74 through eyelet 24, folded back and secured by clip 70. At its other end, flexible cord means 28 can be looped at 76 through eyelet 26, folded back and secured by clip 72.

In another aspect of the present invention, the overall safety of batting practice device 10 is further enhanced by using a safety baseball 12 and a length of elastic cord 18 which enables pitching of the ball without stepping relative to pitching mound 66.

The batting practice device of my prior U.S. Pat. No. 3,767,198 employed a regulation, hard baseball on a propulsion cord or tether which had an elastic section of about 15 inches long. Using this assembly it was possible to propel the baseball at speeds between about 40 to about 80 miles per hour toward the batter. In order to accomplish the higher velocities, however, the elastic length had to be stretched to a length of about 4 feet and the relatively inelastic length of the cord also stretched. Thus, the pitcher had to step away from the batter during elongation or stretching. This step tended to introduce an additional opportunity for error in the pitching technique. The result was more pitches outside the strike zone and a greater possibility of hitting the batter, which, with a regulation hard baseball travelling in excess of 60 or 70 miles per hour, can result in serious injury. If stretched to the extreme, speeds as high as 90 miles per hour were possible. In terms of training young, relatively inexperienced players speeds above 60 miles per hour are not desirable and are dangerous.

In order to avoid this safety problem, batting practice apparatus 10 of the present invention employs a safety baseball 12 of the type disclosed in U.S. Pat. Nos. 4,462,589 and 4,772,019. Such balls will not be described herein in detail, but they are typically formed with a soft, yet resilient, polyurethane core. They have a size equal to that of a regulation baseball, but the ball weight is less than a regulation baseball, e.g., in the 3 to 4 ounce range versus about 5 to 5.25 ounces. Additionally, the present invention can also be advantageously used as a softball (12 inch diameter) training device with safety softballs formed in accordance with U.S. Pat. Nos. 4,462,589 and 4,772,019.

The use of a lighter ball allows elastic cord section 18 to be shortened and still propel ball 12 over the plate at velocities above 40 miles per hour. Moreover, elastic cord section 18 has been reduced in length to about 9 inches. This is very important for two reasons. First, with the lightweight ball 12 and the short elastic section 18, the maximum ball speed is limited to about 60 to about 65 miles per hour. This is fast enough for most amateur player and greatly reduces the risk of injury. Second, the short elastic length 18 allows the pitcher to use a pitching technique which does not require stepping away from anchor 16 or plate 64 during stretching of the elastic.

Instead, pitching is accomplished by the pitcher picking up ball 12 and then standing on mound 66 with one foot in front of another by a comfortable amount to maintain stability. Primary anchor 16 should be placed such that cord 14 is taught when pitcher 70 is on mound 66 and leans and reaches toward the batter 68 while holding ball 12, as shown in solid lines in FIG. 1. The pitcher should not need to step off mound 66 toward the batter to hold the ball with cord 14 taught. The pitcher should only need to lean forward toward anchor 16 and batter 68. The pitcher then leans away from the batter by bending at the waist and slightly at the knees (broken lines in FIG. 1) to substantially fully extend elastic portion 18 without stepping away from the batter. The elastic portion 18 stretched to about eighteen to twenty inches, and the relatively inelastic remainder of cord 14 also stretches somewhat. During the process of leaning back to stretch elastic portion 18, the pitcher's elbow remains straight. Finally, ball 12 is released by tossing it upwardly, as indicated by arrow 80, to propel the ball toward the batter at the proper trajectory.

The result of this lean forward, lean rearward and then toss and release, pitching technique is greater control of the propulsion force and direction than was previously the case. Moreover, the ball now being propelled toward the batter is softer, lighter in weight than a regulation baseball, and travelling at a lower maximum velocity. The risk of injury to the batter is substantially reduced. This safety enhancement is achieved without diminishing the eye-hand coordination training for the hitter, and in fact, the greater number of strikes which can be pitched enhances training of the hitter's eye for strikes.

Three other advantages accrue from this improved batting practice apparatus. First, the shorter elastic section is lighter in weight, which means that it does not slow the speed of the ball as much after the ball is released. Second, the shorter elastic portion more rapidly accelerates and decelerates the ball to avoid the stretchy rubber band or slingshot effect which results in a trajectory with a higher arc and the possibility of uncontrolled backlash against the batter. Third, the shorter elastic section and lightweight softer ball are easier for young children to use. The ball is easier to grip and the elastic section is easier to fully extend.

In the preferred embodiment, elastic portion 18 can be formed of, for example, an elastic BUNGEE or shock cord and preferably should have a relaxed length of about 8 to about 10 inches, with 9 inches being preferred, and a tensioned length of about 16 to about 22 inches. It will be understood that the remainder of cord 14 also stretches somewhat under tensioning. Thus, which cord 14 is a braided, nylonbased, size 24, cord material 21 feet in length, the combined stretch of the relatively inelastic and elastic sections is about 18 inches to about 36 inches.

While a regulation pitching mound is 60 feet 6 inches from plate 64, scaling this distance down to, for example, about 47 feet (a cord 14 having a length of 21, plus a BUNGEE cord section of 9 inches) tends to enhance the accuracy of the pitches and increases the apparent speed of the pitches to the batter. Shortening the distance gives the batter a reaction time equivalent to the higher speed pitches. An eighty mile per hour ball from 60 feet 6 inches requires about 0.52 seconds to reach the plate. A sixty mile per hour ball from 47 feet requires about 0.53 seconds to reach the plate. Thus, the training effect of batting practice device 10 is similar and the safety is considerably enhanced.

For optimum safety for both the pitcher and the batter, batting practice device 10 includes both auxiliary anchor means 20, and lightweight ball 12 and short elastic section 18.

What is claimed is:

1. In a batting practice device including a ball, cord means having a first end attached to said ball, and primary anchor means secured to a second end of said cord means opposite said first end for anchoring said ball at an anchoring position between a pitcher and a batter, said cord means having an elastic portion for propelling said ball by stretching said elastic portion in a direction away from said primary anchor, wherein the improvement in said batting practice device comprises:

an auxiliary anchor means coupled proximate said second end of said cord means to one of said primary anchor means and said second end and limiting propulsion of said primary anchor by said elastic portion in a direction toward said first end, said auxiliary anchor means further being coupled in a manner which does not limit stretching of said elastic portion during propulsion of said ball.

2. The batting practice device as defined in claim 1 wherein, said auxiliary anchor means comprises a mass which rests on the surface of the ground.

3. The batting practice device as defined in claim 1 wherein, said primary anchor means includes an eyelet at its upper end, said auxiliary anchor means includes an eyelet at its upper end, and flexible cord means is fastened between the eyelets.

4. In a batting practice device including a ball, anchor means for anchoring said device to the ground at a position about mid-way between a pitcher and a batter, and flexible cord means coupling said ball to said anchor means, said cord means having an elastic portion enabling propulsion of said ball toward said batter by stretching of said elastic portion and releasing said ball by said pitcher to slingshot said ball toward said batter, wherein the improvement in said batting practice device comprises:

said ball having a weight less than the weight of a regulation baseball and a diameter substantially equal to the diameter of a regulation baseball; and said elastic portion is provided by an elastic cord section having a unstretched length of about 9 inches and a a maximum tensioned length of about 18 inches to permit said pitcher to propel said ball in a simulated pitch by: (i) standing with one foot in front of the other, (ii) leaning forward without stepping toward said anchor means, extending the pitcher's arm until the elbow is straight, and holding said ball with said cord means in a taught condition, (iii) leaning away from said anchor means without stepping away from said anchor means by bending at the waist and knees while maintaining the pitcher's elbow straight to substantially fully extend said elastic portion, and (iv) then tossing said ball upward slightly while releasing said ball.

5. The batting practice device as defined in claim 4 wherein, said cord means other than said elastic portion is formed of a braided nylon material having a length of at least about 18 feet.

6. The batting practice device as defined in claim 5 wherein, said cord means other than said elastic portion has a length in the range of about 18 feet to about 23 feet.

7. The batting practice device as defined in claim 4, and auxiliary anchor means, and flexible tether means connecting said auxiliary anchor means to one of said cord means and said anchor means proximate said anchor means to retard motion of said anchor means in the event said anchor means should be displaced toward said pitcher.

8. The batting practice device as defined in claim 7 wherein, said auxiliary anchor means is provided as a weight.

* * * * *